US005954147A

United States Patent [19]

Overstreet et al.

[11] Patent Number: 5,954,147

[45] Date of Patent: Sep. 21, 1999

[54] EARTH BORING BITS WITH NANOCRYSTALLINE DIAMOND ENHANCED ELEMENTS

[75] Inventors: James Leslie Overstreet, Webster; Danny Eugene Scott, Montgomery, both of Tex.

[73] Assignee: Baker Hughes Incorporated, Houston, Tex.

[21] Appl. No.: 08/890,093

[22] Filed: Jul. 9, 1997

[51] Int. Cl.[6] ..... E21B 10/50

[52] U.S. Cl. ..... 175/374; 175/433; 175/434

[58] Field of Search ..... 175/331, 374, 175/426, 428, 433, 434

[56] References Cited

U.S. PATENT DOCUMENTS

| | | | |
|---|---|---|---|
| 4,911,254 | 3/1990 | Keith | 175/329 |
| 4,976,324 | 12/1990 | Tibbitts | 175/329 |
| 5,030,276 | 7/1991 | Sung et al. | 75/237 |
| 5,304,342 | 4/1994 | Hall, Jr. et al. | 419/11 |
| 5,411,797 | 5/1995 | Davanloo et al. | 428/336 |
| 5,425,965 | 6/1995 | Tamor et al. | 427/249 |
| 5,466,431 | 11/1995 | Dorfman et al. | 423/446 |
| 5,474,808 | 12/1995 | Aslam | 427/249 |
| 5,478,650 | 12/1995 | Davanloo et al. | 428/408 |
| 5,492,186 | 2/1996 | Overstreet et al. | 175/374 |
| 5,523,121 | 6/1996 | Anthony et al. | 427/249 |
| 5,571,616 | 11/1996 | Phillips et al. | 428/336 |
| 5,592,995 | 1/1997 | Scott et al. | 175/374 |
| 5,731,046 | 3/1998 | Mistry et al. | 427/553 |

FOREIGN PATENT DOCUMENTS

| | | | |
|---|---|---|---|
| 0 219 959 A2 | 4/1987 | European Pat. Off. | E21B 10/52 |
| 0 235 455 A2 | 9/1987 | European Pat. Off. | E21B 10/56 |
| 0 352 811 A1 | 1/1990 | European Pat. Off. . | |
| 0 417 924 A1 | 3/1991 | European Pat. Off. | C01B 31/06 |
| 0 493 351 A2 | 7/1992 | European Pat. Off. | C22C 26/00 |
| 0 671 482 A1 | 9/1995 | European Pat. Off. | C23C 16/26 |
| 0 698 447 A2 | 2/1996 | European Pat. Off. | B24D 3/06 |
| 0 715 930 A1 | 6/1996 | European Pat. Off. | B24B 3/16 |
| 0 779 129 A2 | 6/1997 | European Pat. Off. | B24D 3/06 |
| 2 268 768 | 1/1994 | United Kingdom | E21B 10/46 |
| 2 270 493 | 3/1994 | United Kingdom | B24D 3/00 |
| WO 93/05207 | 3/1993 | WIPO | C30B 25/02 |
| WO 93/23204 | 11/1993 | WIPO | B24D 3/00 |

OTHER PUBLICATIONS

H. Hirai et al., Transparent nanocrystalline diamond ceramics fabricated from $C_{60}$ fullerene by shock compression, Appl. Phys. Lett., vol. 71, No. 20, Nov. 17, 1997.

"Fullerenes", Scientific American, Oct. 1991, pp. 54–63.

"CVD Diamond—A New Technology For The Future?", Endeavour Magazine, vol. 19(3), (1995), pp. 101–106.

"Heat Treating/Coating", Advanced Materials & Processes, Jan. 1997, pp. 12–13.

"Researchers Find A Way To Form Film Of Diamond Using Carbon 'Buckyballs'", Wall Street Journal, Nov. 6, 1991, p. B4.

"Much Ado About Bucky", Mechanical Engineering, Apr. 1993, p. 104.

"The Stability Of The Fullerenes $C_n$, With n=24, 28,32, 36, 50, 60 and 70", Nature, vol. 329, No. 6139, Oct. 8, 1987, pp. 529–531.

*Primary Examiner*—William Neuder

*Attorney, Agent, or Firm*—Charles D. Gunter, Jr.

[57] ABSTRACT

An earth boring bit is shown of the type used to drill subterranean formations. The bit body has an upper extent which is threaded for connection in a drill string extending to the earth's surface. A lower extent of the bit body has a number of cutting elements mounted thereon which engage an earthen formation and cut the formation. At least selected ones of the cutting elements incorporate a nanocrystalline diamond material.

15 Claims, 5 Drawing Sheets

EARTH BORING BITS WITH NANOCRYSTALLINE DIAMOND ENHANCED ELEMENTS

BACKGROUND OF THE INVENTION

1. Field of the Invention

The present invention relates generally to earth boring bits of both the fixed cutter and the rolling cutter variety. More specifically, the present invention relates to the cutting structures and cutting elements of such earth boring bits.

2. Description of the Prior Art

Commercially available earth boring bits can generally be divided into the rolling cutter bits, having either steel teeth or tungsten carbide inserts and fixed cutter or drag bits. Modern fixed cutter bits typically utilize either natural diamonds or artificial or man-made diamonds as cutting elements. The diamond containing fixed bits can be generally classified as either steel bodied bits or matrix bits. The steel bodied bits are machined from a steel block and typically have cutting elements which are press-fit into openings provided in the bit face. The matrix bit is formed by coating a hollow tubular steel mandrel in a casting mold with metal bonded hard material, such as tungsten carbide. The casting mold is of a configuration which will give a bit of the desired form. In the past, the cutting elements were typically either polycrystalline diamond compact (PDC) cutters braised within an opening provided in the matrix backing or are thermally stable polycrystalline diamond cutters which are cast within recesses provided in the matrix backing.

The rolling cutter bit employs at least one rolling cone cutter, rotatably mounted thereon. As with the fixed or drag bit, the rolling cutter bit is secured to the lower end of a drill string that is rotated from the surface of the earth. The cutters mounted on the bit roll and slide upon the bottom of the borehole as the drill string is rotated, thereby engaging and disintegrating the formation material.

Despite their generally similar overall function, fixed bits and rolling cutter bits are subjected to different operative forces which dictate fundamental design differences. For example, in the case of rolling cutter bits, the cutters roll and slide along the bottom of the borehole. The cutters, and the shafts on which they are rotatably mounted, are thus subjected to large static loads from the weight on the bit, and large transient or shock loads encountered as the cutters roll and slide along the uneven surface of the bottom of the borehole. Thus, earth boring bits of the rolling cutter variety are typically provided with precision formed journal bearings and bearing surfaces, as well as sealed lubrication systems to increase the drilling life of the bits. The lubrication systems typically are sealed to avoid lubricant lose and to prevent contamination of the bearings by foreign matter such as abrasive particles encountered in the borehole. A pressure compensator system minimizes pressure differential across the seal so that lubricant pressure is equal to or slightly greater than the hydrostatic pressure in the annular space between the bit and the sidewall of the borehole. These features would not normally be present in the fixed cutter or drag bit.

Super-hard materials, including natural and synthetic diamond materials, have been used in fixed cutter or drag type bits for many years. Recently, there has been a general effort to introduce the improved material properties of natural and synthetic diamond type materials into earth boring bits of the rolling cutter variety, as well. However, differences in the forces exerted upon the cutting elements of fixed cutter bits versus bits of the rolling cutter variety come into play. Fixed cutter bits employ the shearing mode of disintegration of the earthen formation almost exclusively. Although diamond and other super-hard materials possess excellent hardness and other material properties, they are generally considered too brittle for most cutting element applications in rolling cutter bits, with an exception being the shear cutting gage insert of such bits. The gage cutters, located on the corner and sidewall of the cutter are subjected to crushing and scraping or shearing actions, while the borehole wall is produced in a pure sliding and scraping (shearing) mode. In the corner and on the sidewall of the borehole, the cutting elements have to do most of the work and are subjected to extreme stresses, which makes them prone to breakdown prematurely and/or wear rapidly.

Recent attempts to introduce diamond and similar materials into rolling cutter bits have relied on a diamond layer or table secured to a substrate or backing material of fracture-tough hard metal, usually cemented tungsten carbide. The substrate is thought to supplement the diamond or super-hard material with its increased toughness, resulting in a cutting element with satisfactory hardness and toughness which diamond alone is not thought to provide.

In addition to the problem of brittleness, diamond inserts of the above general type have presented additional problems, such as the tendency of the diamond or super-hard material to delaminate from the substrate. Several attempts have been made to increase the strength of the interface. U.S. Pat. No. 4,604,106, to Hall et al., discloses a transition layer interface that gradually transitions between the properties of the super-hard material and the substrate material at the interface between them to resist delamination. U.S. Pat. No. 5,544,713, to Dennis, uses an interrupted interface on the metal carbide stud to reduce spalling. U.S. Pat. No. 5,351,772, to Smith, provides a non-planar interface between the diamond table and the substrate. U.S. Pat. No. 5,355,969, to Hardy et al. is another example of a non-planar interface between a super-hard material and the substrate in a PDC drill bit.

Thus, many of the prior art attempts to incorporate diamond or other super-hard materials into the cutting structures of earth boring bits have presented design problems which compromised the overall performance characteristics of the bits.

A need exists, therefore, for earth boring bits having super-hard cutting elements that are relatively easy to manufacture with a satisfactory combination of material properties.

A need also exists for an earth boring bit having wear surfaces, such as the cutting surfaces and cutting elements, with improved properties to extend the useful life of the bit.

Another object of the invention is to provide a earth boring bit having diamond reinforced wear surfaces which surfaces are less brittle and are less likely to delaminate from their substrate than were the prior art materials.

A need also exists for an earth boring bit having cutting elements with a lower coefficient of friction formed by finer diamond starting materials and possessing smoother surfaces than cutting elements of the prior art.

SUMMARY OF THE INVENTION

It is the general object of the present invention to provide an earth boring bit with improved wear-resistant surfaces which extend the useful life of the bit.

Another object of the invention is to provide an earth boring bit which has super-hard cutting elements with satisfactory material properties.

These and other objects of the present invention are achieved by providing an earth boring bit having a bit body with a plurality of wear surfaces. At least selected ones of the wear surfaces incorporate a nanocrystalline diamond material to improve the performance of the wear surface, thereby extending the surface life of the earth boring bit. Preferably, the earth boring bit includes a bit body having an upper extent with means for connection to a drill string for rotation about a longitudinal axis and having a lower extent. A plurality of cutting elements are mounted on the lower extent of the bit body and are adapted to engage an earth formation and cut the earth formation. At least selected ones of the cutting elements incorporate a nanocrystalline diamond material.

In the case of a rolling cone bit having at least one rotatable cone mounted thereon, the rotatable cone has a plurality of cutting elements arranged in circumferential rows thereon. At least selected ones of the cutting elements are formed at least partly of nanocrystalline diamond material. In the case of a fixed cutter bit, the bit body has a plurality of PDC cutting elements mounted thereon. At least selected ones of the cutting elements are formed at least partly of nanocrystalline diamond material.

Additional objects, features and advantages will be apparent in the written description which follows.

DETAILED DESCRIPTION OF THE INVENTION

Figure 1:
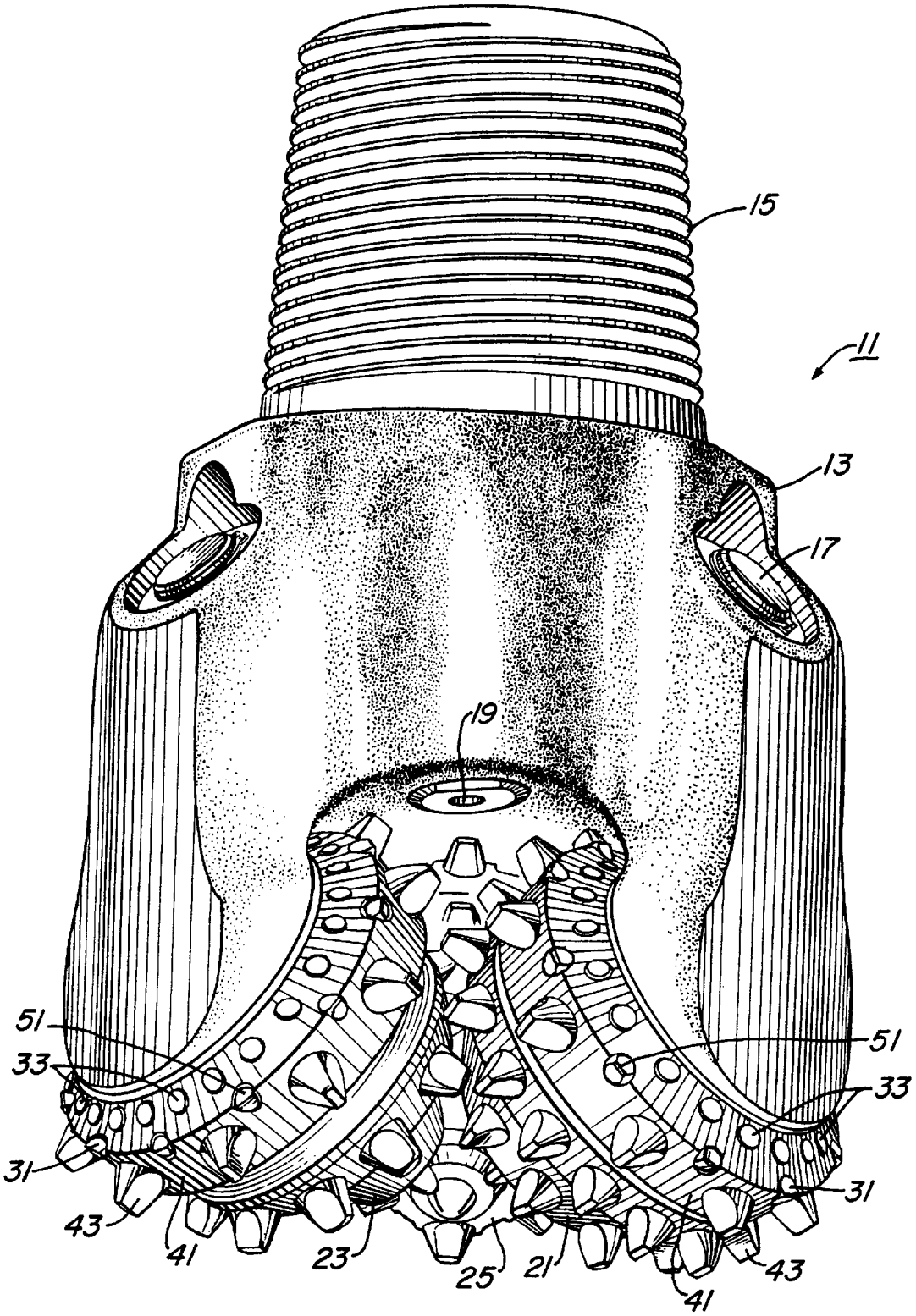
FIG. 1 is perspective view of an earth boring bit according to the present invention.

Turning to FIG. 1, a rolling cone earth boring bit 11 of the present invention is illustrated. The bit 11 includes a bit body 13, which is threaded at its upper extent 15 for connection into a drill string (not shown) leading to the surface of the well bore. Each leg or section of the bit 11 is provided with a lubricant compensator 17 to adjust or compensate for changes in the pressure or volume of lubricant provided for the bit. At least one nozzle 19 is provided in bit body 13 to spray drilling fluid from within the drill string to cool and lubricate bit 11 during drilling operations. Three cutters 21, 23, 25 are rotatably secured to a bearing shaft associated with each leg of the bit body 13. Each cutter 21, 23, 25 has a cutter shell surface including an outermost or gage surface 31 and a heel surface 41 immediately inward and adjacent the gage surface 31. A plurality of cutting elements, in the form of hard metal, diamond or super-hard inserts, are arranged in generally circumferential rows on each cutter. For example, the bit 11 illustrated in FIG. 1 has gage elements 33 and heel inserts 43 arranged in circumferential rows on each cutter. A scraper element 51 is also secured to the cutter shell surface generally at the intersection of the gage and heel surfaces 31, 41 and generally intermediate a pair of heel inserts 43.

The outer cutting structure, comprising heel cutting elements 43, gage cutting elements 33 and a secondary cutting structure in the form of chisel-shaped trimmer or scrapper elements 51 combine and cooperate to crush and scrap formation material at the corner and sidewall of the borehole as cutters 21, 23, 25 roll and slide over the formation material during drilling operations. According to the preferred embodiment of the present invention, at least one, and preferably several, of the cutting elements in one or more of the rows is formed at least partly of a nanocrystalline diamond material.

Figure 2:
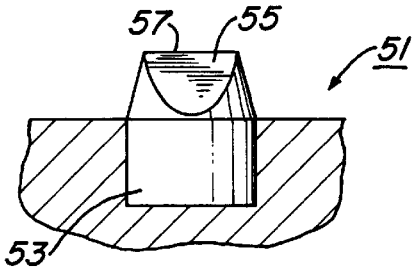
FIG. 2 is an elevational view of a nanocrystalline diamond cutting element for the heel or inner-rows of an earth boring bit according to the present invention.

FIG. 2 is an elevational view, partially in section, of a nanocrystalline diamond cutting element 51 according to the present invention. Cutting element 51 comprises a generally cylindrical base 53 which is secured in an aperture or socket in the cutter by interference fit or brazing. Cutting element 51 is a chisel-shaped cutting element that includes a pair of flanks 55 that converge to define a crest 57. Chisel-shaped cutting elements are particularly adapted for use as the trimmer elements (51 in FIG. 1), a heel element (43 in FIG. 1) or other inner-row cutting elements. A chisel-shaped element is illustrated as an exemplary trimmer, heel or inner-row cutting element. Other conventional shapes, such as ovoids, cones, or rounds are contemplated by the present invention, as well.

Figure 3:
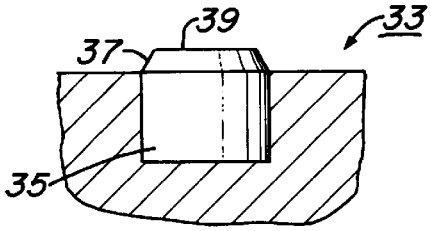
FIG. 3 is an elevation view of a nanocrystalline diamond cutting element for the gage rows of an earth boring bit according to the present invention.

FIG. 3 is an elevational view, partially in section, of a nanocrystalline diamond gage row insert 33 according to the present invention. Gage row insert 33 comprises a generally cylindrical body 35 which is provided at the cutting end with a chamfer 37 that defines a generally frusto-conical cutting surface. The intersection between cutting surface 37 and flat top 39 defines a cutting edge for shearing engagement with the sidewall of the borehole.

Both the chisel-shaped element 51 and the gage insert 33 are formed at least in part of a super-hard material which, in the case of the present invention, is a nanocrystalline diamond material. The super-hard nanocrystalline diamond material will have a hardness in excess of 3500–5000 on the Knoop scale and is to be distinguished from merely hard ceramics, such as silicon carbide, tungsten carbide, and the like. Most nanocrystalline materials are in the range from about 10 to 100 nanometers. All materials in this size range are referred to herein as "nano" materials as distinguished from submicron materials.

Until recent years, only two crystalline forms of carbon were known to exist, graphite and diamond. Recently, a third form of carbon in polygonal arrangement of hexagonal and pentagonal faces has been characterized by Dr. Richard Smalley of Rice University in Texas. Dr. Smalley discovered that the carbon molecule formed a geodesic sphere similar to a soccer ball. In addition, he discovered that these structures of carbon contain anywhere from 32 atoms of carbon to hundreds of carbon atoms including $C_{60}$, $C_{70}$, $C_{76}$, $C_{84}$, $C_{90}$ and $C_{94}$, with $C_{60}$ predominating. These molecules are referred to as "Buckminsterfullerenes" or "fullerenes" due to their geodesic shape and are sometimes referred to informally as "buckyballs." The three dimensional shape of these molecules gives them unique physical and chemical properties. The sphere shape provides the molecules with a high resistance to compressibility with a hardness which has been estimated to be near that of diamond.

More recent technology has made it possible to convert "buckyballs" to diamond using, for example, a high pressure, high temperature apparatus (HPHT). Other techniques also exist, for example, in January, 1992, a French team at the Center For Very Low Temperature Research, Grenoble, France, succeeded in converting $C_{60}$ to diamond in a high pressure apparatus at approximately room temperature. The $C_{60}$ powder was compressed in a diamond anvil cell. The diamond anvils in the cell are slightly slanted relative to each other, resulting in a considerable pressure gradient across the cell. The material retrieved from the cell after compression is a polycrystalline powder, confirmed as diamond by X-ray and electron diffraction analysis.

The price of a gram of commercially available mixed fullerenes has recently dropped from around $1,200.00 per gram to below about $50.00 per gram making these materials more commercially feasible for industrial applications. Such mixed fullerenes can be obtained commercially from Texas Fullerenes of Houston, Tex.; Materials And Electrochemical Research Corporation of Tucson, Ariz., Bucky U.S.A. of Bellaire, Tex., and others. The purity of the mixed fullerenes varies from about 92% $C_{60}$ to 98% $C_{60}$ with the balance being higher molecular weight fullerenes. Other versions of nanocrystalline diamond material are contemplated, as well. The fullerene starting materials of the invention are preferably at least about 95% $C_{60}$, most preferably at least about 98% $C_{60}$.

The nanocrystalline diamond materials of the invention are typically formed at high pressure and temperature conditions under which the materials are thermodynamically stable using conventional PDC technology known by those skilled in the art. For example, an insert may be made by forming a refractory metal container or can to the desired shape, and then filling the can with buckyball powder to which a small amount of metal material (commonly cobalt, nickel or iron) has been added. The container is then sealed to prevent any contamination. Next, the sealed can is surrounded by a pressure transmitting material which is generally salt, boron nitride, graphite or similar material. This assembly is then loaded into a high pressure and temperature cell. The design of the cell is dependent upon the type of high pressure apparatus being used. The cell is compressed until the desired pressure is reached and then heat is supplied via a graphite-tube electric resistance heater. Temperatures in excess of 1350° C. and pressures in excess of 50 kilobars may be employed. At these conditions, the added metal is molten and acts as a reactive liquid phase to enhance sintering of the buckyball material. After a few minutes, the conditions are reduced to room temperature and pressure. The insert is then broken out of the cell and can be finished to final dimensions through grinding or shaping.

In the typical PDC manufacturing method using the high pressure, high temperature (HPHT) apparatus, the high temperature and pressure conditions cause the cobalt binder to become liquid and to move from the substrate into the diamond causing diamond-to-diamond bonding to occur. Consequently, the diamond attaches itself to the carbide substrate. This procedure creates high residual stresses in the part, however, which can lead to premature failure. By substituting fullerenes or other nanocrystalline starting materials as the carbon source, the carbon material can be converted to diamond at lower pressure and temperatures than graphite in an HPHT apparatus.

Other techniques are known in the art for providing nanophase diamond layers and films including the use of nanocrystalline starting materials other than "buckyballs." For example, see U.S. Pat. No. 5,478,650, issued Dec. 26, 1995, to Davanloo et al. which teaches the production of nanometer scale nodules of diamond bonded carbon structures. The nanophase diamond films have diamond-like properties indicating a preponderance of $sp^3$ bonds within the nodules and a substantial absence of hydrogen and graphite within the nodules. The nanophase diamond films can be created to have a hardness exceeding that of natural diamond, depending on the quantity of graphite left in the voids between the nodules. The nanophase diamond films are characterized by a low coefficient of friction and by a low average internal stress.

In the Davanloo process, a moving sheet of hardened graphite foil is placed within a vacuum chamber with the chamber being evacuated and a laser beam being directed at an angle upon the graphite foil to obtain a plume of carbon substantially void of macroscopic particles having dimensions generally greater than 1 micron. A substrate is positioned in the chamber and an electrical field is disposed within the path of the laser beam between the substrate and the target. A portion of the plume is collected at selective points upon the substrate in accordance with the electrical field at a deposition rate greater than 0.1 microns per hour, more typically about 0.5 microns per hour.

Another technique for creating a nanocrystalline diamond material of the type useful for the purposes of the present invention has been developed by Diamond Partnership, Argonne National Lab, Argonne, Ill. In that procedure, films are produced of nanocrystalline diamond with 20 to 50 nanometers RMP roughness, independent of film thickness. They have an average grain size of 15 nm. The process employed uses either $C_{60}$ fullerenes or buckyballs or a hydrocarbon such as methane as the carbon source in an inert gas plasma to produce the carbon dimer $C_2$, which acts as the growth species. Uniform growth and good adhesion has been demonstrated for silicon, silicon carbide, silicon nitride, tungsten and tungsten carbide substrates.

Figure 12:
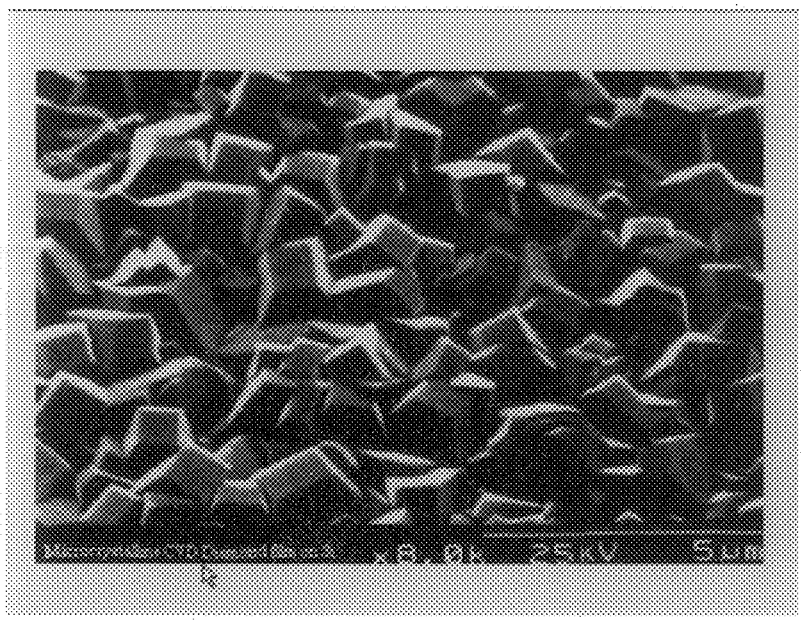
FIG. 12 is a microscopic view of a microcrystalline diamond film applied by a chemical vapor deposition techniques to a silicon substrate.
Figure 13:
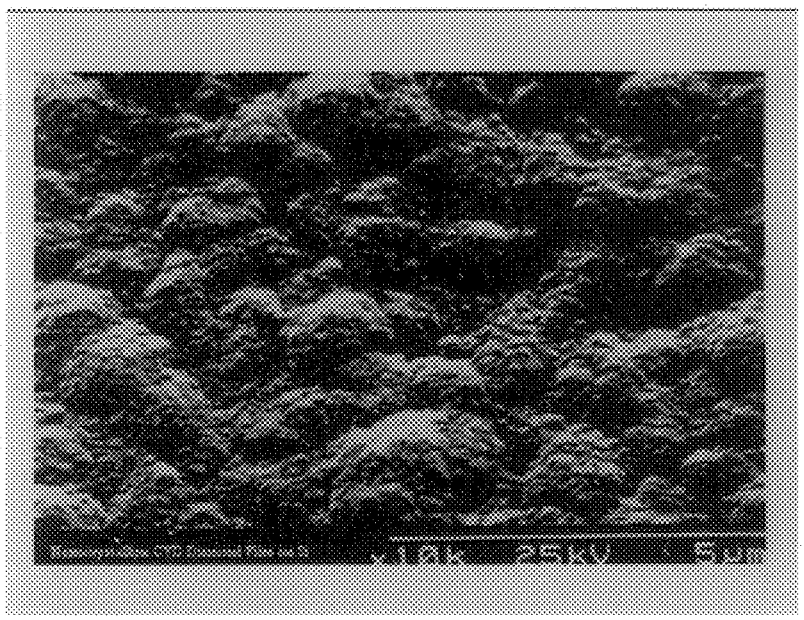
FIG. 13 is a microscopic view of a nanocrystalline diamond film applied by chemical vapor deposition techniques to a silicon substrate.

Chemical vapor deposition processes can also be used to apply the nanocrystalline diamond materials of the invention directly to a substrate. Chemical vapor deposition, as its name implies, involves a gas-phase chemical reaction occurring above a solid surface, which causes deposition onto that surface. CVD techniques for producing diamond films require a means of activating gas-phase carbon-containing precursor molecules. This generally involves thermal or plasma activation, or the use of a combustion flame. Growth of diamond normally requires that the substrate be maintained at a temperature in the range from about 1,000–1,400° K and that the precursor gas be diluted in an excess of hydrogen. The fact that diamond films can be formed by the CVD technique is linked to the presence of hydrogen atoms, which are generated as a result of the gas being "activated", either thermally or via electron bombardment. FIGS. 12 and 13 are SEM photomicrographs made by Dr. Paul May, School of Chemistry, University of Bristol, United Kingdom. In order to differentiate the prior art microcrystalline films from the nanocrystalline films of the invention, FIG. 12 shows the surface morphology obtained by the CVD deposition of a microcrystalline diamond film upon a silicon substrate. The film is polycrystalline, with facets appearing both as square and rectangular forms. FIG. 13 illustrates a nanocrystalline film of the invention which exhibits the "cauliflower" morphology typical of such materials. The nanocrystalline film is much smoother than the microcrystalline film allowing for the production of PDC parts with a significantly finer finish than conventionally made PDC parts.

A CVD technique for depositing ultra fine grained polycrystalline diamond films is disclosed in U.S. Pat. No. 5,425,965, issued Jun. 20, 1995, to Tamor et al. Diamond nucleation is enhanced by ultrasonic treatment of the substrate surface with a fluid which consists essentially of unsaturated oxygen-free hydrocarbons and diamond grit. Another article describing the application of diamond films generally using CVD techniques is "CVD Diamond-A New Technology For The Future", May, Endeavor Magazine, (1995), pp. 101–106.

In addition to the previously described techniques, including the conversion of fullerenes and vapor deposition of nanocrystalline diamond materials directly to an insert, other techniques may be employed as well. These techniques include the treating of a vapor coated insert in an HPHT apparatus to improve bonding; sintering of nanocrystalline diamond powder in an HPHT apparatus directly to the carbide element; layering of the nanocrystalline diamond on the surface with a conventional PDC layer underneath and between the nanocrystalline diamond and the carbide to create an especially wear-resistant surface and a courser, tougher intermediate diamond layer; vapor coating of a PDC coated insert with a nanocrystalline diamond film; and combinations of the above techniques.

According to one embodiment of the present invention, at least the cutting surfaces of elements 51, 33 are formed entirely of nanocrystalline diamond material. It will be understood, however, that all of the nanocrystalline diamond materials of the invention can contain at least traces of other materials such as the cobalt binder used in traditional polycrystalline diamond manufacturing techniques.

Figure 4:
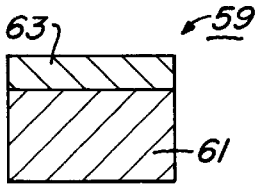
FIGS. 4–6 are simplified, isolated views of various forms of the nanocrystalline diamond cutting elements of the invention showing various forms of the nanocrystalline diamond material attached to a tungsten carbide substrate.
Figure 5:
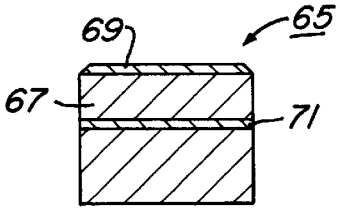
Figure 6:
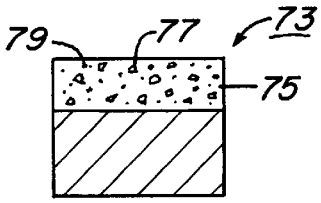
Figure 7:
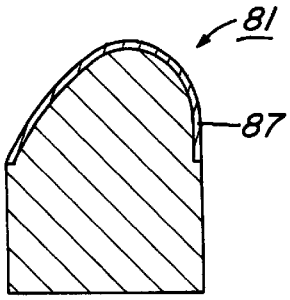
FIGS. 7–9 are simplified, isolated views of chisel type cutting elements showing the application of a layer of nanocrystalline diamond material to the wear surfaces thereof.
Figure 8:
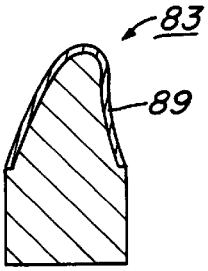
Figure 9:
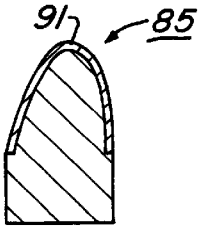

It may be desirable to provide a cutting element having a cutting end or surface which is formed entirely of nanocrystalline diamond material with a portion of the element formed of a less wear-resistant and more easily formed material. For example, FIG. 4 shows a cutting element 59 having a cylindrical body 61 formed of cemented tungsten carbide and a cutting surface or end 63 which is formed entirely of nanocrystalline diamond material. In FIG. 5, a cutting element 65 is shown having a cutting end with a layer of coarser or seed diamonds 67 sandwiched between an outer and inner layer 69, 71 of nanocrystalline diamond material. By "coarser" diamond layer is meant a layer made up of, e.g., microcrystalline diamond material. FIG. 6 shows a cutting element 73 in which the cutting end 75 includes coarser diamonds 77 interspersed with fullerene material 79. FIGS. 7–9 show chisel-shaped cutting elements 81, 83, 85, each of which includes a nanocrystalline diamond layer 87, 89, 91, respectively, applied to a wear surface thereof, as by chemical vapor deposition techniques.

Figure 10:
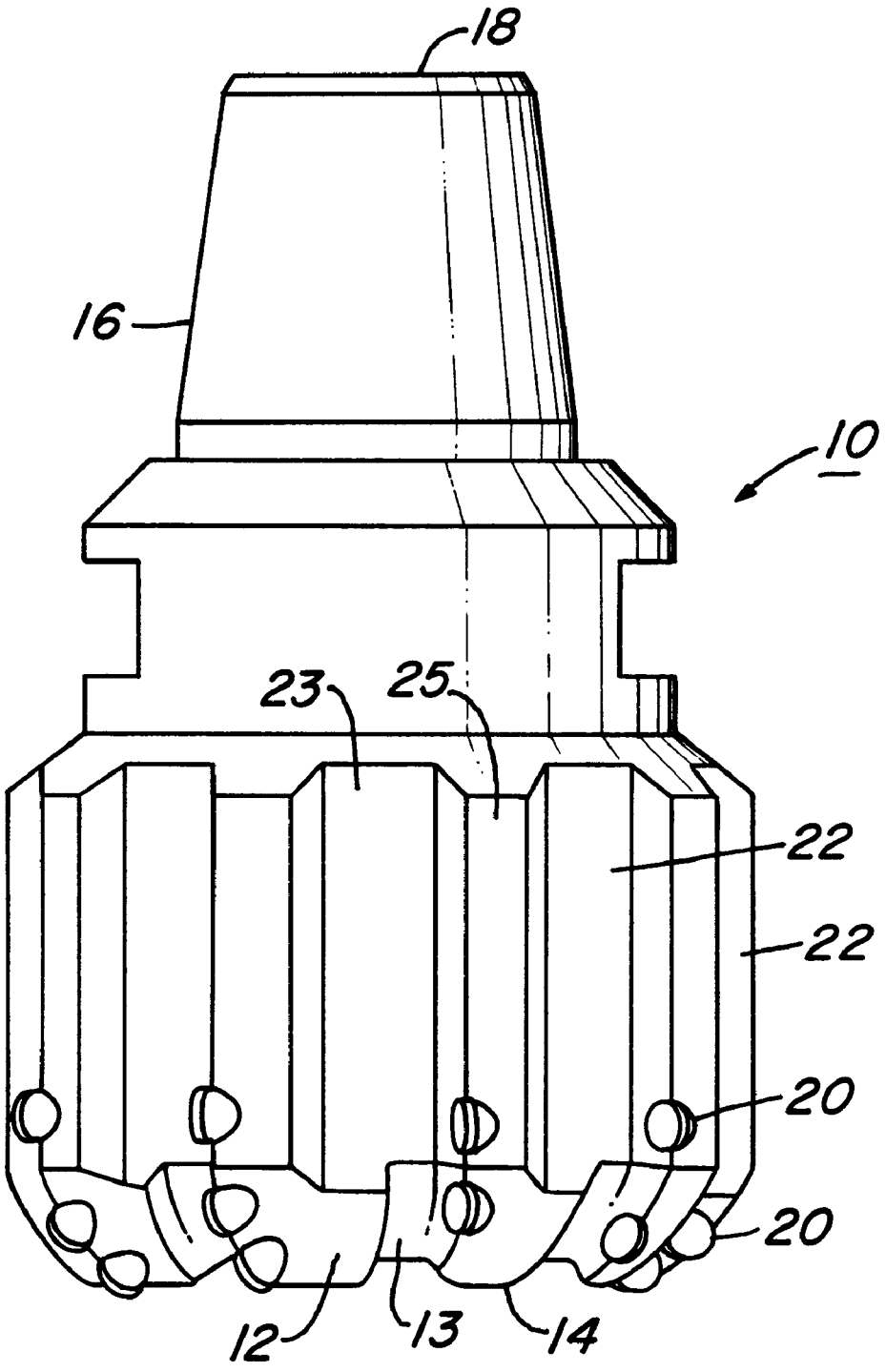
FIG. 10 is a side, elevational view of a rotary drag bit featuring cutting elements of the invention.
Figure 11:
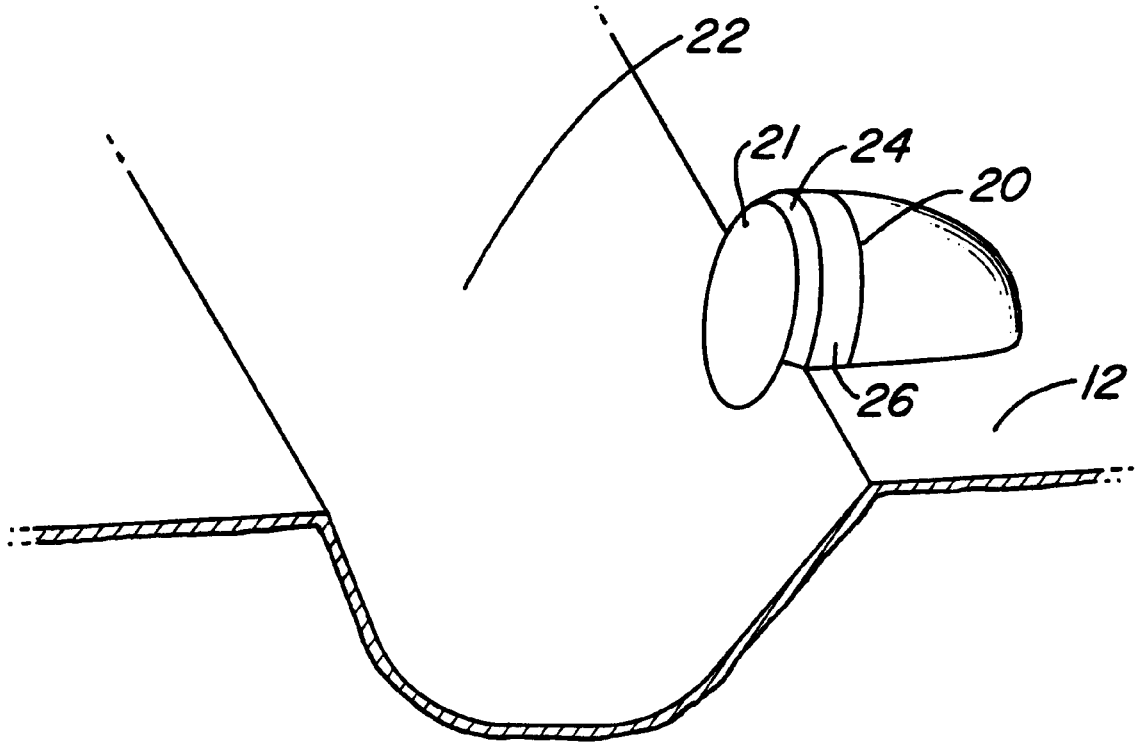
FIG. 11 is a side, sectional view of the bit of FIG. 10 showing a cutting element attached thereto.

FIGS. 10 and 11 illustrate a rotary drag bit 10 manufactured in accordance with the present invention. The fixed cutter bit 10 has a face 12 including waterways 13 at a distal end 14 and a connector 16 at a proximal end 18. A plurality of cutting elements 20 are attached to the face 12 oriented to cut a subterranean formation during rotation of the bit 10. The bit 10 also has a plurality of junk slots 22 on the face 12 so that drilling fluid and formation cuttings may flow up through the junk slots 22 and into the borehole (not shown) Generally the junk slots 22 are defined by a recessed portion 23 and a raised portion or gage pad 25 that may optionally contain one or more cutting elements 20.

Referring to FIG. 11, a perspective view of a cutting element 20 with a sectional view of the face 12 of the bit of FIG. 10 is illustrated. The cutting element 20 has a cutting face or surface 21 formed of the nanocrystalline diamond material which is bonded to and supported by a substrate 26. The cutting element 20 is then attached to the bit face 12 by methods known in the art (e.g., brazing) so that approximately ½ of the cutting face 21 is exposed above the face 12. Typically, the cutting elements are located adjacent a waterway 13 on the bit face or junk slot 22 so that formation chips generated during the drilling process may flow up through the recessed portion 23 and into the borehole (not shown).

A earth boring bit according to the present invention posses a number of advantages. A primary advantage is that the earth bore bit is provided with more efficient and durable cutting elements. Some time and temperature are needed in the HPHT process using a nanocrystalline starting material to allow the diamonds to bond to each other and to the substrate; however, the time will be relatively minimal which will reduce internal stresses. Due to the nano-size of the starting materials, more diamonds will be in contact with the formation being drilled, thereby improving penetration rates and longevity of PDC bits. In addition, the PDC parts of the invention have a significantly finer finish than conventionally made PDC parts. The finer finish helps to reduce post HPHT lapping, thereby reducing manufacturing costs. The finer finish and resulting lower coefficient of friction of the cutting elements produced helps prevent a drilled formation from sticking to the parts, further improving penetration rates. The size of the nanocrystalline diamond material lends itself more readily to producing different geometries with less internal stresses compared to conventional diamond materials either in whole or in combination in PDC parts.

While the invention has been described with reference to preferred embodiments thereof, it is not thus limited but is susceptible to various changes and modifications without departing from the spirit thereof.

What is claimed is:

1. An earth boring bit used to drill subterranean formations, comprising:

a bit body having an upper extent with means for connection to a drill string for rotation about a longitudinal axis and having a lower extent;

a plurality of cutting elements mounted on the lower extent of the bit body adapted to engage an earth formation and cut the earth formation, at least selected ones of the cutting elements incorporating a nanocrystalline diamond material; and wherein the nanocrystalline diamond material which forms at least part of the cutting elements is formed from a nanocrystalline diamond powder which has been sintered in an HPHT type apparatus at a temperature below that conventionally employed for graphite, thereby reducing residual stresses in the resulting cutting element.

2. The earth boring bit of claim 1, wherein the bit is a rolling cone bit having at least one rotatable cone mounted thereon, the rotatable cone having a plurality of cutting elements arranged in circumferential rows thereon, at least selected ones of the cutting elements being formed at least partly of nanocrystalline diamond material.

3. The earth boring bit of claim 1, wherein the bit is a fixed cutter bit having a plurality of PDC cutting elements mounted thereon, at least selected ones of the cutting elements being formed at least partly of nanocrystalline diamond material.

4. The earth boring bit of claim 1, wherein the nanocrystalline diamond material which forms at least part of the cutting elements is a nanocrystalline fullerene carbon material which has been converted to diamond.

5. The earth boring bit of claim 4, wherein the fullerene carbon material is predominately $C_{60}$ with the balance being $c_{70}$, $C_{76}$, $c_{84}$ and $c_{92}$.

6. The earth boring bit of claim 1, wherein the nanocrystalline diamond material which forms at least part of the cutting elements is formed from a nanocrystalline diamond powder which has been sintered in an HPHT apparatus directly to a carbide substrate which forms a portion of the cutting element.

7. The earth boring bit of claim 1, wherein the nanocrystalline diamond material forms a surface layer on the cutting element with a conventional PDC layer underneath and between the nanocrystalline diamond layer and a conventional carbide portion of the cutting element.

8. An earth boring bit used to drill subterranean formations, comprising:

a bit body having a bit face on one end and a shank on an opposite end with means for connection to a drill string for rotation about a longitudinal axis;

a plurality of PDC cutting elements mounted on the bit face, the cutting elements having cutting faces adapted to engage an earth formation and cut the earth formation, at least selected ones of the cutting elements incorporating a nanocrystalline diamond material to improve the wear resistance thereof and thereby extend the service life of the earth boring bit; and wherein the nanocrystalline diamond material which forms at least part of the cutting elements is formed from a fullerene nanocrystalline diamond powder which has been sintered in an HPHT type apparatus directly to a carbide substrate at a temperature below about 1350 degrees C., said temperature being that conventionally employed for graphite, thereby reducing residual stresses in the resulting cutting element.

9. An earth boring bit, comprising:

a bit body;

at least one bearing shaft depending inwardly and downwardly from the bit body;

a cutter mounted for rotation on the bearing shaft, the cutter including a plurality of cutting elements arranged on the cutter in circumferential rows, the circumferential rows including a gage row proximal the outer most surface of the cutter;

at least one of the cutting elements in one of the gage rows being formed at least in part of a nanocrystalline diamond material; and wherein the nanocrystalline diamond material which forms at least part of the cutting elements is formed from a nanocrystalline diamond powder which has been sintered in an HPHT type apparatus at a temperature below that conventionally employed for graphite, thereby reducing residual stresses in the resulting cutting element.

10. The earth boring bit of claim 9, wherein the gage row cutting element comprises:

a frusto-conical cutting end projecting from the cutter having a cutting surface thereon;

a generally cylindrical base secured in an aperture in the cutter;

the cutting surface of the cutting element being formed entirely of nanocrystalline diamond material.

11. An earth boring bit, comprising:

a bit body;

at least one bearing shaft depending inwardly and downwardly from the bit body;

a cutter mounted for rotation on the bearing shaft, the cutter including a plurality of cutting elements arranged on the cutter in circumferential rows, the circumferential rows including inner rows;

at least one of the cutting elements in an inner row being formed at least partly of nanocrystalline diamond material; and wherein the nanocrystalline diamond material which forms at least part of the cutting elements is formed from a nanocrystalline diamond powder which has been sintered in an HPHT type apparatus at a temperature below that conventionally employed for graphite, thereby reducing residual stresses in the resulting cutting element.

12. The earth boring bit of claim 11, wherein the inner row cutting element comprises:

a cutting end projecting from the cutter and having a cutting surface thereon;

a generally cylindrical base carrying the cutting end at one extent thereof and being secured in a socket in the cutter at an opposite extent thereof;

the cutting surface of the cutting element being formed at least partly of nanocrystalline diamond material.

13. The earth boring bit of claim 12, wherein the cutting surface of the cutting element comprises a layer of predominately nanocrystalline diamond material bonded to a carbide substrate.

14. The earth boring bit of claim 12, wherein the cutting surface of the cutting element comprises a layer of blended nanocrystalline diamond applied over coarser diamond bonded to a carbide substrate.

15. The earth boring bit of claim 12, wherein the cutting surface of the cutting element comprises a layer of predominately nanocrystalline diamond material bonded to a layer of coarser diamonds which is bonded, in turn, to a carbide substrate.

* * * * *